US010612795B2

(12) United States Patent
Gagne

(10) Patent No.: US 10,612,795 B2
(45) Date of Patent: Apr. 7, 2020

(54) METHODS AND SYSTEM FOR DEMAND-BASED CONTROL OF A COMBINATION BOILER

(71) Applicant: Lochinvar, LLC, Lebanon, TN (US)

(72) Inventor: Curtis George Gagne, Smyrna, TN (US)

(73) Assignee: Lochinvar, LLC, Lebanon, TN (US)

( * ) Notice: Subject to any disclaimer, the term of this patent is extended or adjusted under 35 U.S.C. 154(b) by 625 days.

(21) Appl. No.: 15/265,029

(22) Filed: Sep. 14, 2016

(65) Prior Publication Data

US 2018/0073748 A1 Mar. 15, 2018

(51) Int. Cl.
*F24D 19/10* (2006.01)
*F24D 3/08* (2006.01)

(52) U.S. Cl.
CPC ..... *F24D 19/1069* (2013.01); *F24D 3/08* (2013.01); *F24D 2220/042* (2013.01); *F24D 2220/06* (2013.01)

(58) Field of Classification Search
CPC ..... F24D 3/08; F24D 19/1069
USPC ..... 237/8 A
See application file for complete search history.

(56) References Cited

U.S. PATENT DOCUMENTS 3,201,045 A * 8/1965 Davidson ..... F24D 3/08 122/356
4,224,825 A * 9/1980 Feller ..... G01K 17/16 374/41
4,738,394 A * 4/1988 Ripka ..... F24D 3/08 236/20 R
4,880,157 A * 11/1989 Boot ..... F23N 1/002 236/25 R
5,097,802 A * 3/1992 Clawson ..... F22B 1/26 122/31.1

(Continued)

FOREIGN PATENT DOCUMENTS

EP 2006607 A2 12/2008
EP 2372260 A2 * 10/2011 ..... F24D 19/1009

(Continued)

OTHER PUBLICATIONS

Baehr, et al., Heat and Mass Transfer, 2006, pp. 40-57, 2006 (Year: 2006).*

(Continued)

*Primary Examiner* — Grant Moubry
*Assistant Examiner* — Phillip Decker
(74) *Attorney, Agent, or Firm* — Lucian Wayne Beavers; Grant M. Ford; Patterson Intellectual Property Law, PC

(57) ABSTRACT

A combination boiler provides heated water to a boiler loop and heated domestic hot water (DHW) to a DHW loop. A primary heat exchanger is connected to the boiler loop. A burner provides heat to the primary heat exchanger and an input fan supplies a fuel and air mixture to the burner. A secondary heat exchanger transfers heat energy from the boiler loop to a domestic water loop. A controller determines a boiler loop flow rate. The controller measures an input temperature of the boiler loop, an output temperature of the boiler loop, and a DHW output temperature of the domestic water loop. The controller determines a DHW input temperature and estimates a DHW flow rate. The input fan speed is initiated or operated according to a required heat output of the burner corresponding to the DHW flow rate.

12 Claims, 5 Drawing Sheets

(56) References Cited

U.S. PATENT DOCUMENTS

| | | | | |
|---|---|---|---|---|
| 5,775,236 | A * | 7/1998 | Fenn | F23N 1/062 110/185 |
| 6,332,580 | B1 * | 12/2001 | Enander | B60H 1/00364 237/12.3 B |
| 6,647,932 | B1 * | 11/2003 | Cui | F24H 1/52 122/33 |
| 6,694,926 | B2 * | 2/2004 | Baese | F23D 14/02 122/14.2 |
| 8,186,313 | B2 * | 5/2012 | Paine | F23N 1/082 122/14.22 |
| 8,498,523 | B2 * | 7/2013 | Deivasigamani | F24D 17/0026 392/307 |
| 8,910,880 | B2 * | 12/2014 | Farrell | F24D 3/08 122/15.1 |
| 8,971,694 | B2 * | 3/2015 | Deivasigamani | G06F 16/9574 392/308 |
| 9,182,159 | B2 * | 11/2015 | Hatada | F25B 27/00 |
| 9,945,566 | B2 * | 4/2018 | Park | F24H 1/523 |
| 10,012,396 | B2 * | 7/2018 | Deivasigamani | F24D 9/00 |
| 2003/0213246 | A1 * | 11/2003 | Coll | F01K 17/02 60/653 |
| 2005/0022542 | A1 | 2/2005 | Sakakibara | |
| 2007/0295830 | A1 * | 12/2007 | Cohen | F24D 12/02 237/8 A |
| 2010/0116225 | A1 * | 5/2010 | Smelcer | F23D 14/02 122/17.1 |
| 2010/0230088 | A1 | 9/2010 | Clark et al. | |
| 2010/0252029 | A1 * | 10/2010 | Kanai | F24D 11/003 126/643 |
| 2011/0259322 | A1 | 10/2011 | Davis et al. | |
| 2013/0279891 | A1 | 10/2013 | Laing | |
| 2015/0300661 | A1 * | 10/2015 | Park | F24H 1/523 237/8 R |
| 2015/0338129 | A1 * | 11/2015 | Matsuzawa | F24H 4/04 122/14.3 |
| 2016/0047558 | A1 * | 2/2016 | Shimada | F24D 19/1069 237/8 A |
| 2016/0178221 | A1 * | 6/2016 | Thornton | F24D 19/1069 700/295 |
| 2016/0320075 | A1 * | 11/2016 | Deivasigamani | F24D 19/1066 |
| 2017/0102165 | A1 * | 4/2017 | Brekken | F24H 1/201 |
| 2018/0073749 | A1 * | 3/2018 | Gagne | F24D 3/08 |

FOREIGN PATENT DOCUMENTS

| | | | |
|---|---|---|---|
| EP | 2573471 | A1 | 3/2013 |
| WO | 2005050100 | A2 | 6/2005 |
| WO | 2012077333 | A2 | 6/2012 |
| WO | 2013130701 | A1 | 9/2013 |
| WO | 2015082708 | A1 | 6/2015 |
| WO | 2016145154 | A1 | 9/2016 |

OTHER PUBLICATIONS

International Search Report for corresponding International application No. PCT/US2017/042742 dated Nov. 2, 2017, 17 pages (not prior art).

International Preliminary Report on Patentability for corresponding International Patent Application No. PCT/US2017/042742, dated Mar. 19, 2019, 33 pages (not prior art).

Canadian Office Action for corresponding patent application 3,031,925, dated Nov. 25, 2019, 9 pages (not prior art).

* cited by examiner

METHODS AND SYSTEM FOR DEMAND-BASED CONTROL OF A COMBINATION BOILER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to controlling burner fan control for a combination boiler. More particularly, the present invention relates to suitably initializing, modifying, or controlling the firing rate of an input fan of a combination boiler for a Domestic Hot Water (DHW) demand based on an estimated DHW flow rate, a DHW set point, and an error in a DHW output temperature.

Current combination boiler implementations suffer drawbacks associated with initially and continuously undershooting and overshooting heated water temperatures when attempting to provide DHW at a desired set point temperature. One attempted solution is to provide a DHW output flow sensor within a combination boiler to determine a DHW output flow rate and to use the directly measured DHW output flow rate to adjust a boiler loop temperature to compensate for the DHW output flow rate. However, providing a DHW flow sensor adds both cost and complexity to a combination boiler. Furthermore, flow sensors typically have a minimum flow rate detection threshold, below which the flow sensor does not detect a current flow rate. Thus, low DHW output flow rates are not detected and heated DHW output may be significantly delayed or DHW output may be concluded before heated water is provided.

Problems also arise with combination boilers that initialize a burner input rate (e.g., fan speed) only on a proportional term. For example, if a DHW output temperature is close to a set point temperature when the burner fires, an input fan of the burner may initialize at a low input rate, causing a significant DHW output temperature undershoot. The combination burner may significantly overshoot the DHW output temperature when there is a low DHW output flow rate or when the initial DHW output temperature is significantly lower than the set point temperature.

It would therefore be desirable for a combination boiler to provide heated water as quickly as possible with minimal overshoot or undershoot of a DHW output set point temperature.

BRIEF SUMMARY OF THE INVENTION

An invention as disclosed herein may solve the above described problems by:

In one exemplary embodiment, provided is a method of controlling domestic hot water (DHW) output temperature in a combination boiler, the combination boiler including a primary heat exchanger connected to a boiler loop, a burner configured to provide heat to the primary heat exchanger, an input fan configured to supply a fuel and air mixture to the burner, and a secondary heat exchanger configured to transfer heat energy from the boiler loop to a domestic water loop. The method includes first determining a boiler loop flow rate. An input temperature of the primary heat exchanger, an output temperature of the primary heat exchanger, and a DHW output temperature of the secondary heat exchanger are measured. A DHW input temperature is determined, and a DHW flow rate is estimated based at least in part upon the boiler loop flow rate, the input temperature of the primary heat exchanger, the output temperature of the primary heat exchanger, and a difference between the DHW output temperature and the DHW input temperature. The input fan is initialized or operated according to a required heat output of the burner corresponding to the DHW flow rate.

In another exemplary embodiment, a combination boiler system is configured to provide heated water to a boiler loop and heated domestic hot water (DHW) to a DHW loop. The combination boiler system includes a primary heat exchanger connected to the boiler loop. The combination boiler system further includes a burner configured to provide heat to the primary heat exchanger and an input fan configured to supply a fuel and air mixture to the burner. The combination boiler includes a secondary heat exchanger configured to transfer heat energy from the boiler loop to a domestic water loop, and a controller. The controller is configured to determine a boiler loop flow rate. The controller is further configured to measure an input temperature of the boiler loop, an output temperature of the boiler loop, and a DHW output temperature of the domestic water loop. The controller is configured to determine a DHW input temperature and to estimate a DHW flow rate based at least in part upon the boiler loop flow rate, the input temperature of the boiler loop, the output temperature of the boiler loop, and a difference between the DHW output temperature and the DHW input temperature. The controller is further configured to operate the input fan according to a required heat output of the burner corresponding to the DHW flow rate.

In a further exemplary embodiment, a method of controlling domestic hot water (DHW) output temperature in a combination boiler is provided. The combination boiler includes a primary heat exchanger connected to a boiler loop, a burner configured to provide heat to the primary heat exchanger, an input fan configured to supply a fuel and air mixture to the burner, and a secondary heat exchanger configured to transfer heat energy from the boiler loop to a domestic water loop. The method begins by initiating a domestic water loop flow and a boiler loop flow. An inlet temperature and an outlet temperature of the primary heat exchanger are measured. A DHW output temperature of the secondary heat exchanger is measured. A DHW flow rate is determined based on a boiler loop flow rate, a boiler loop temperature differential based on the inlet temperature and the outlet temperature, and a DHW temperature differential between the DHW output temperature and a DHW input temperature. A required heat output associated with the burner is calculated, the required heat output being defined as the DHW flow rate multiplied by a difference between the DHW output temperature and the DHW input temperature. The input fan is initialized, modified, or otherwise controlled at a fan rate corresponding to the required heat output.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
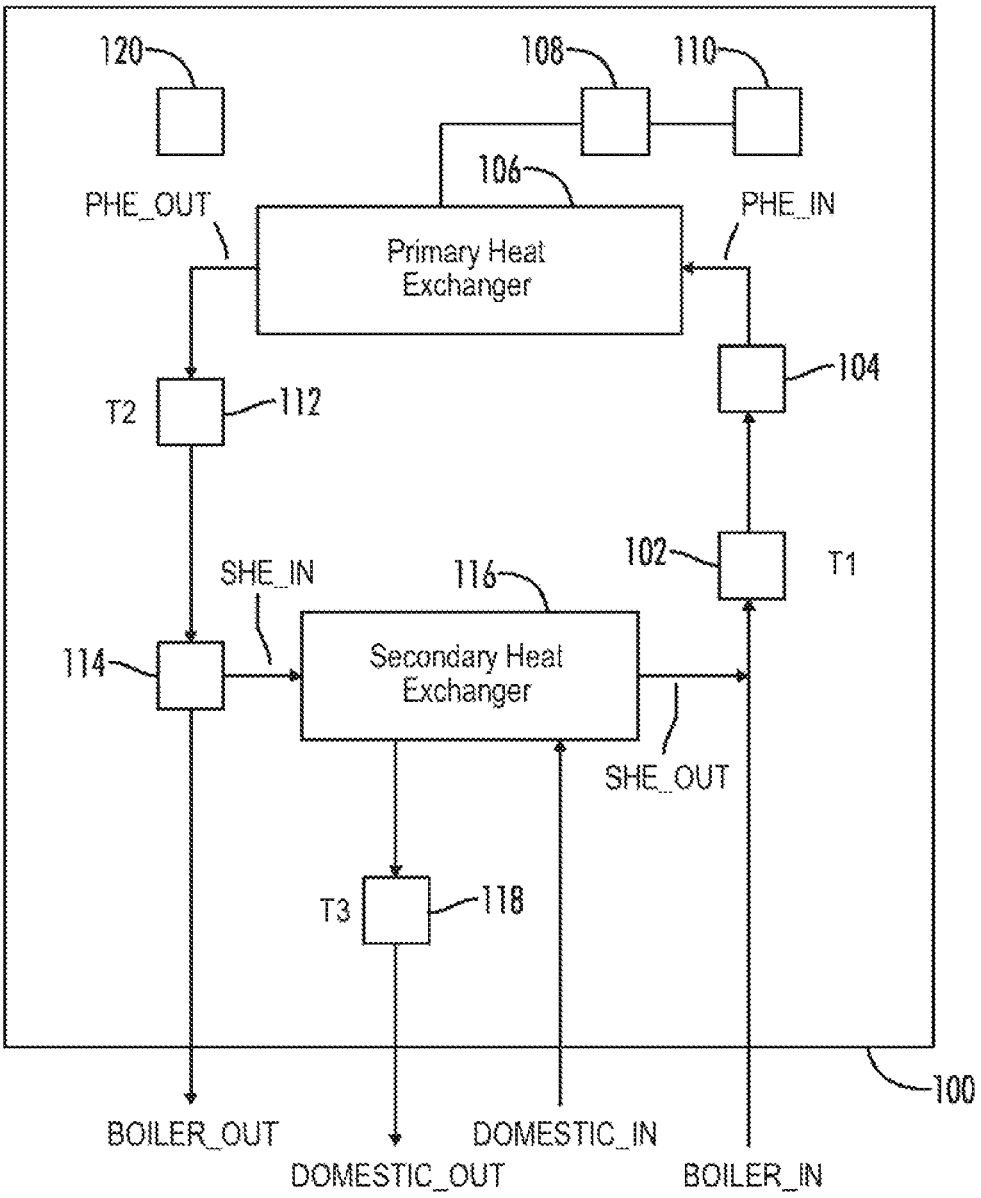
FIG. 1 is a graphical block diagram illustrating a combination boiler consistent with an exemplary embodiment.

Referring generally to FIGS. 1-5, various exemplary embodiments of an invention may now be described in detail. Where the various figures may describe embodiments sharing various common elements and features with other embodiments, similar elements and features are given the same reference numerals and redundant description thereof may be omitted below.

Various embodiments disclosed herein are directed to methods and systems for demand-based initialization of a combination boiler. In the embodiments described herein, a domestic hot water (DHW) output temperature sensor may be used to detect a DHW output temperature of a combination boiler.

FIG. 1 illustrates a graphical block diagram illustrating a combination boiler consistent with an exemplary embodiment. The combination boiler 100 is configured to control operations associated with two water loops. The first loop is a boiler loop connected to the combination boiler 100 at an input BOILER_IN of the combination boiler 100 and an output BOILER_OUT of the combination boiler 100. In various embodiments the boiler loop may be configured to provide space heating or hydronic heating. The combination boiler 100 also includes a domestic water loop for providing potable water. The domestic loop connects to the combination boiler 100 at an input DOMESTIC_IN of the combination boiler 100 and is output from the combination boiler 100 at an output DOMESTIC_OUT. Although described as a loop, it should be appreciated that the domestic loop may take the form of either a closed or open flow loop. For example, the domestic loop may include one or more domestic water input sections configured to input domestic water into the domestic water loop.

In operation, the combination boiler 100 is configured to provide heat energy from the boiler loop to the domestic loop in order to provide heated domestic hot water (DHW) output. Boiler loop water is input to the combination boiler 100 at BOILER_IN and flows toward the primary heat exchanger (PHE) inlet temperature sensor 102. Although illustrated in FIG. 1 as being located within the combination boiler 100, it should be appreciated that the PHE inlet temperature sensor 102 may be physically located either internally or externally to the combination boiler 100, without departing from the spirit and scope of the present disclosure. A detected PHE inlet temperature T1 is measured by the PHE inlet temperature sensor 102. After passing the primary heat exchanger inlet temperature sensor 102, boiler loop water flows toward an inlet pump 104. In various embodiments, inlet pump 104 is configured to regulate a flow rate of boiler water in the boiler loop. The output of the inlet pump 104 (also illustrated with reference to PHE_IN in FIG. 1) continues to a primary heat exchanger 106.

Primary heat exchanger 106 may take the form of a shell and tube heat exchanger, a plate heat exchanger, a plate and shell heat exchanger, a fire-tube combustion heat exchanger, a water-tube combustion heat exchanger, an adiabatic wheel heat exchanger, a plate fin heat exchanger, a pillow plate heat exchanger, a fluid heat exchanger, a waste heat recovery heat exchanger, a dynamic scraped surface heat exchanger, a phase-change heat exchanger, a direct contact heat exchanger, a microchannel heat exchanger, or any other physical device capable of transferring heat energy to boiler loop water.

The primary heat exchanger 106 includes or is otherwise connected to a burner 108 or other heat source configured to provide heat. The burner 108 is configured to heat water contained within the boiler loop. The burner 108 may be configured to include an input fan 110. Although described with reference to a fan it should be appreciated that the input fan 110 may be replaced by a water bypass configured to vary an amount of heat used to vary an amount of heated water passed through the secondary heat exchanger 116. In this exemplary embodiment, the bypass may be configured to be controlled (e.g., by the controller 120 rather than explicitly by the input fan 110). The input fan 110 is configured to supply a fuel and air mixture to the burner 108. Although the input fan 110 is described as part of the burner 108 in various embodiments, the input fan 110 may optionally be physically separate from the burner 108. Furthermore, at least one of the burner 108 and the input fan 110 may be physically located internally or externally (or a combination thereof) to the combination boiler 100. Although not illustrated in FIG. 1, the combination boiler 100 may include an energy input module configured to receive one or more sources of energy for use by the burner 108. For example, the combination boiler 100 may include a heating oil or natural gas input, where the heating oil or natural gas input is used by the burner 108 to provide heat energy to boiler loop water via the primary heat exchanger 106. Although described with reference to a burner, it should be appreciated that the burner 108 may take the form of one or more elements configured to provide heat energy to boiler loop water at the primary heat exchanger 106, and may or may not require the use of the input fan 110 during operation depending upon a particular implementation. In one or more exemplary embodiments, a burner 108 may take the form of one or more heating elements configured to regulate an amount of heat supplied to boiler loop water or domestic loop water.

Heated water is output from the primary heat exchanger 106 along output PHE_OUT. Heated water output from the primary exchanger 106 is received at PHE outlet temperature sensor 112. The PHE outlet temperature sensor 112 is configured in one embodiment to measure a PHE outlet temperature T2. Heated boiler loop water is received at the flow diverting valve 114 after passing the PHE temperature sensor 112. The flow diverting valve 114 is configured to provide a selected amount of heated water from the boiler loop to at least one of the boiler output BOILER_OUT and the secondary heat exchanger 116 (via input SHE_IN). In operation, the flow diverting valve 114 may be configured to direct all or a portion of heated water output from the primary heat exchanger 106 to the secondary heat exchanger 116. In various embodiments the flow diverting valve 114 may be configured to output all heated water from the primary heat exchanger 106 via the BOILER_OUT output. In one exemplary embodiment, a flow path corresponding to the combination boiler 114 may be configured to bypass the BOILER_OUT and BOILER_IN of the combination boiler 114. In this exemplary embodiment, one or more additional temperature and/or flow sensors may be implemented in the combination boiler 100 (for example, one or more sensors may be provided corresponding to the SHE_OUT path). The additional one or more sensors may be implemented, for example, because a temperature at PHE inlet temperature sensor 102 might not match the SHE_OUT temperature (e.g., because of a potential status as a mixture of water, potentially at a different temperature measured relative to at least one of an inlet and an outlet of the secondary heat exchanger 116 rather than an inlet or an outlet of the primary heat exchanger 106)).

Secondary heat exchanger 116 is configured to receive domestic input water (e.g., potable water) via input DOMESTIC_IN. The secondary heat exchanger 116 is configured to heat input domestic water by transferring heat energy received from the boiler loop to the domestic loop. Heated water output from the primary heat exchanger 106 is directed by the flow diverting valve 114 and through the secondary heat exchanger 116. In one exemplary embodiment, heated domestic hot water is output from the secondary heat exchanger 116. Although described with reference to a PHE outlet temperature, it should be appreciated that the PHE outlet temperature sensor 112 may be located at an input section of the secondary heat exchanger 116 and may, in one or more embodiments, correspond to an input temperature of the secondary heat exchanger 116 (for example, the PHE outlet temperature sensor 112 may be located at least one of before or after the flow diverting valve 114. A temperature of the domestic hot water output measured by a DHW output temperature sensor 118 in one exemplary embodiment. The DHW output temperature sensor 118 is configured to measure a domestic hot water temperature T3. After passing the DHW output temperature sensor 118, domestic loop heated water is output from the combination boiler 100 via the output DOMESTIC_OUT.

A controller 120 is configured to control operations of at least one component of the combination boiler 100. The controller 120 may be configured to include or otherwise access one or more memory storage elements to store or obtain at least one parameter used by the controller 120 to control at least a portion of operations performed by or corresponding to the combination boiler 100.

In one exemplary embodiment the controller 120 is configured to control operations of at least one of the flow diverting valve 114 and the inlet pump 104 to cause a predetermined amount of heated boiler loop water to be diverted from the boiler loop into the secondary heat exchanger 116 in order to transfer heat energy to domestic loop water. The controller 120 may be configured to provide domestic hot water output at a predetermined temperature (e.g., at a predetermined or user-specified set point temperature). Boiler loop water is output from the secondary heat exchanger 116 via the output SHE_OUT after transferring at least a portion of its heat energy to the domestic loop water. In one exemplary embodiment, boiler loop water output from the secondary heat exchanger 116 is received at the boiler loop at a position before the PHE inlet temperature sensor 102. Additionally or alternatively, at least a portion of the output boiler loop water from the secondary heat exchanger 116 may be received at any point of the boiler loop without departing from the spirit and the scope of the present disclosure.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable medium known in the art. An exemplary computer-readable medium can be coupled to the processor such that the processor can read information from, and write information to, the memory/storage medium. In the alternative, the medium can be integral to the processor.

Figure 2:
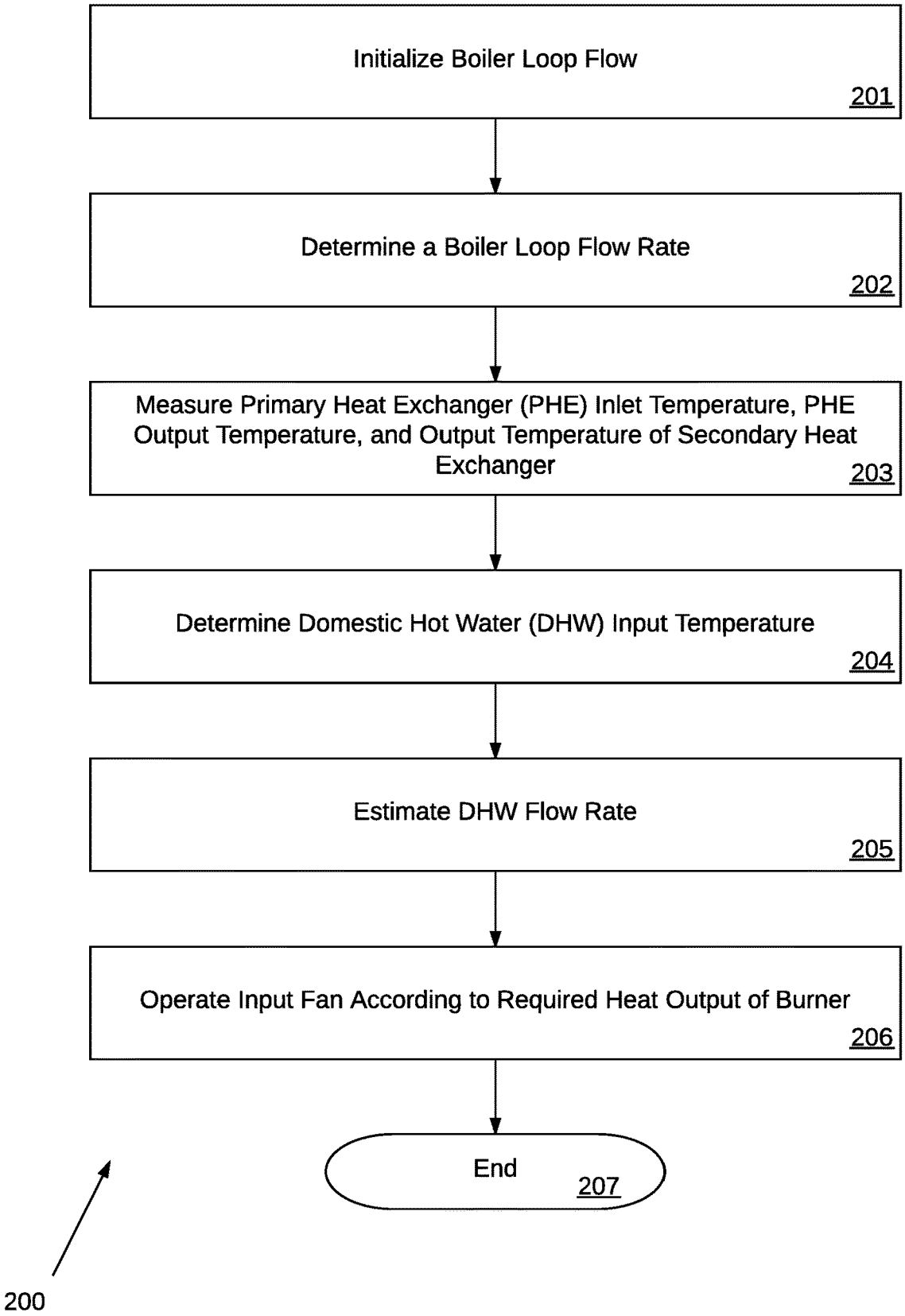
FIG. 2 is a flowchart representing a process for controlling an input fan of a combination boiler according to an exemplary embodiment.

FIG. 2 illustrates a flowchart providing a process for initializing, modifying, or otherwise controlling an input fan of a combination boiler according to an exemplary embodiment. The process 200 begins at a step 201, where a boiler loop flow is initialized. The boiler loop flow may be initialized, for example, by domestic water output (e.g., a draw of water for a domestic water loop associated with the secondary heat exchanger 116). The process continues at a step 202, where a boiler loop flow rate is determined. In one exemplary embodiment, the boiler loop flow rate is determined based at least in part upon an operational characteristic of the inlet pump 104. Additionally or alternatively, the boiler loop flow rate may be measured, assumed, or determined, and may correspond to a flow rate of boiler loop water passing through the secondary heat exchanger 116 via the flow diverting valve 114. At a step 203, a primary heat exchanger inlet temperature, a primary heat exchanger outlet temperature, and an output temperature of a secondary heat exchanger are measured at a step 203. In one exemplary embodiment, the primary heat exchanger inlet temperature corresponds to T1, the primary heat exchanger outlet temperature corresponds to T2, and the output temperature of the secondary heat exchanger corresponds to T3 as illustrated by FIG. 1 and as previously described herein. In one exemplary embodiment, a boiler loop flow rate may correspond to or otherwise relate to an amount of boiler loop water passing through the secondary heat exchanger 116.

At a step 204, a DHW input temperature is determined. At step 205 a DHW flow rate is estimated based at least in part upon at least one of the boiler loop flow rate, the input temperature of the primary heat exchanger, the output temperature of the primary heat exchanger, and the difference between the DHW output temperature and the DHW input temperature. After estimating the domestic hot water flow rate, the controller 120 may be configured to cause the combination boiler 100 to operate the input fan 110 of the combination boiler 100 according to a required heat output of the burner 108 corresponding to a set point temperature. In one exemplary embodiment, the required heat output of the burner 108 corresponds to the DHW flow rate. The domestic hot water flow rate may be calculated using the equation:

$$\text{DHW Flow Rate}=(\text{Boiler Flow Rate}*\text{Boiler}_{D}T)/(\text{DHW}_{D}T) \quad \text{(Eq. 1)}$$

A required heat output of the burner 108 may be calculated according to the equation:

$$\text{Heat Output}=\text{DHW Flow Rate}*(\text{DHW Set Point Temperature}-\text{DHW Inlet Temperature}) \quad \text{(Eq. 2)}$$

A DHW inlet temperature may take the form of an assumed or measured temperature associated with input domestic water received at the combination boiler 100. In various embodiments, the DHW inlet temperature may be at least one of a predetermined value and an assumed value. Additionally or alternatively, the DHW inlet temperature maybe directly or indirectly measured at the DOMESTIC_IN input of the combination boiler 100, for example by a temperature sensor (not illustrated) located in the combination boiler 100. The controller 120 may be configured to provide a feed-forward control system, whereby the DHW output temperature T3 may be used in combination with at least one of the PHE inlet temperature T1 or the PHE outlet temperature T2 to modify or compensate for an assumed or measured DHW input temperature (as described herein with reference to FIG. 4, below).

At a step 206 the input fan 110 is controlled according to a required heat output of the burner 108. After initialization, the controller 120 may be configured to perform further feed-back or feed-forward control of the input fan 110 to cause the DHW output temperature T3 to satisfy a set point temperature and/or to cause a boiler loop flow rate to be modified. For example, the input rate (e.g., initial fan speed) may be modified by adding a term proportional to an amount of air to cause the input fan 110 to transition the DHW output temperature to a particular DHW set point temperature. Alternatively or additionally, the boiler loop flow rate may be modified. In one exemplary embodiment the DHW set point temperature corresponds to a desired temperature of output domestic hot water from the domestic loop. The controller 120 may be configured to modify an operational characteristic of at least one of the inlet pump 104 and the flow diverting valve 114 to cause a temperature of the output DHW to correspond to a predetermined DHW set point temperature. As previously described, the controller 120 may be configured to control, modify or otherwise initialize a heat input rate (e.g., fan speed) of the input fan 110 to account for variation in actual DHW inlet temperature with an assumed domestic hot water inlet temperature. The process 200 ends at a step 207.

Although described with respect to an input fan, it should be appreciated that one or more heat sources may be used to provide the heat input rate corresponding to the primary heat exchanger 106. In one exemplary embodiment, an input fan may be configured to supply a volume of fuel and/or air, or a mixture thereof, to the burner 108 proportional to a given heat demand or input. In one or more exemplary embodiments, a fan speed as described herein may relate to a heat input associated with the primary heat exchanger 106. Alternatively or additionally, heat input corresponding to the burner 108 may be provided by one or more heating elements (e.g., an electric heating element) configured to be controlled by the controller 120. In one exemplary embodiment, the controller 120 may be configured to control one or more electric heating elements configured to provide a heat output characteristic to the one or more heating elements corresponding to a heating demand. Even further additionally or alternatively, the one or more heating elements are configured in one exemplary embodiment to supply an appropriate amount of fuel, air, heat, or other operational setting to the one or more heating elements (e.g., via one or more settings or pulses corresponding to an on/off heat source). An operational setting of the input fan 110 or one or more heating elements may be configured to correspond to an input heating demand and/or input. Optionally, a fan speed of the input fan 110 may be configured to correspond to a specific heat input.

Figure 3:
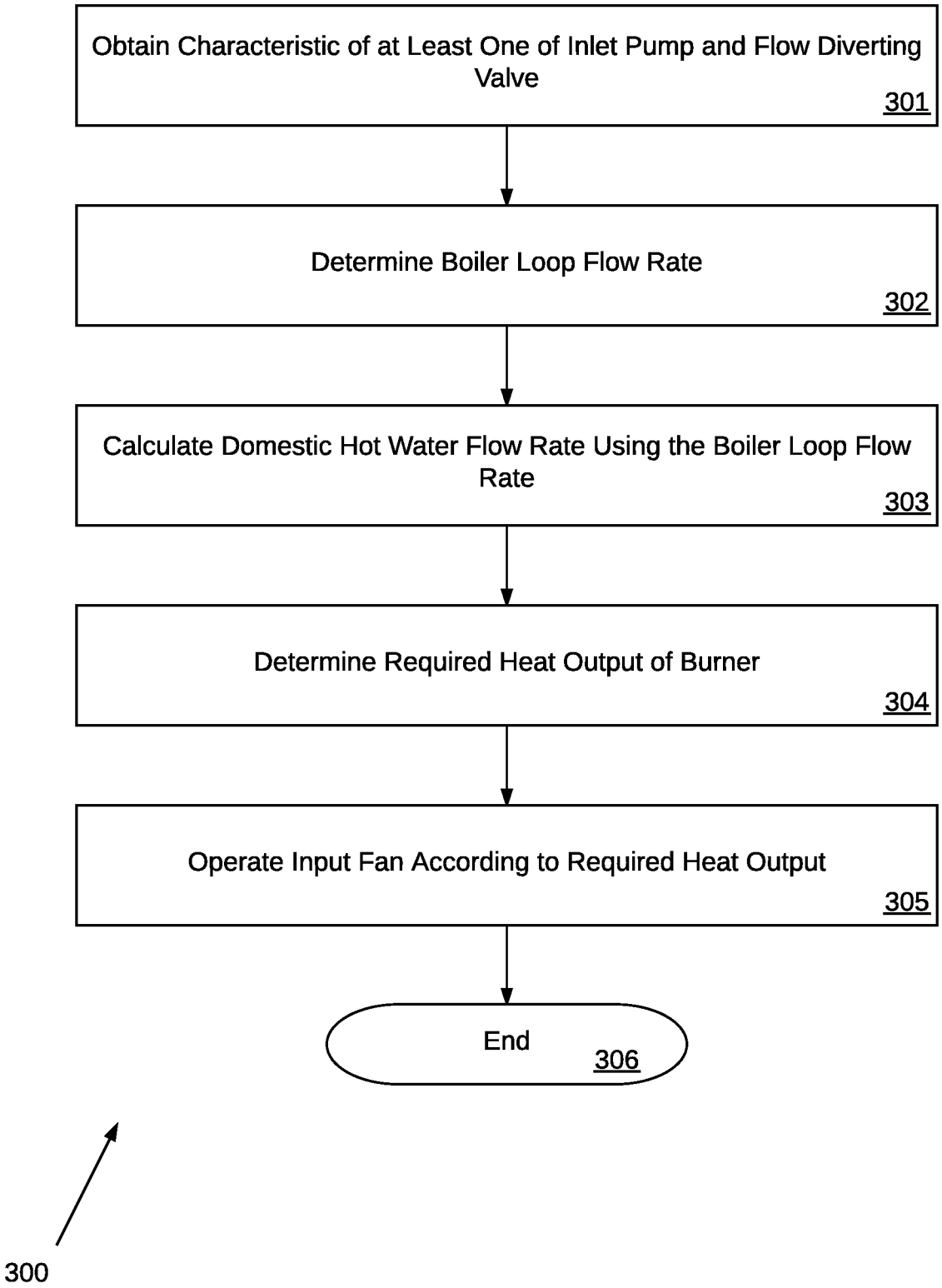
FIG. 3 is a flowchart representing an exemplary boiler loop flow rate determination process for burner initialization according to an embodiment.

FIG. 3 provides a flowchart representing a boiler loop flow rate determination process for burner control according to an exemplary embodiment. The process 300 begins at a step 301, where a characteristic of at least one of the inlet pump 104 and flow diverting valve 114 is obtained. The process continues to a step 302, where a boiler loop flow rate is determined. The boiler loop flow rate may be determined at the step 302 in the manner previously described herein. A DHW output flow rate is calculated using the boiler loop flow rate at a step 303. At step 304 a required heat output of burner 108 is determined. The input fan 110 is then initialized and/or operated according to the required heat output at a step 305. The process then concludes at a step 306.

Figure 4:
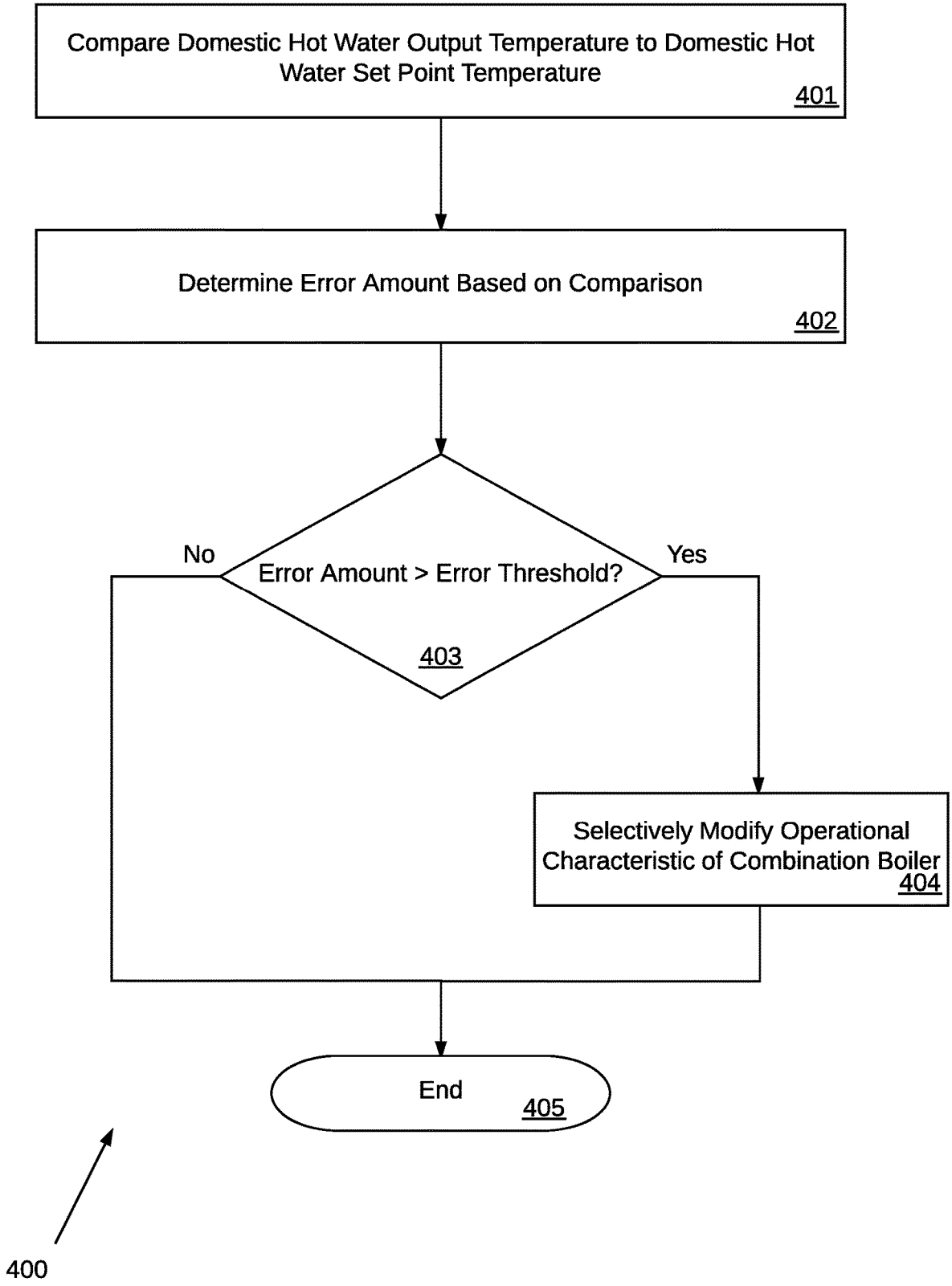
FIG. 4 is a flowchart representing an exemplary DHW output temperature error correction process according to an exemplary embodiment.

FIG. 4 provides a flowchart representing a DHW output temperature error correction process according to an exemplary embodiment. The process 400 begins at a step 401, where a DHW output temperature is compared to a domestic hot water set point temperature. An error amount is determined at step 402 based on the comparison between the DHW output temperature and the DHW set point temperature. It is determined at a step 403 whether the error amount is greater than an error threshold. In one exemplary embodiment, the error threshold may take the form of a particular range associated with the domestic hot water set point temperature (e.g., as an offset such as +/−3 degrees or as a percentage of the domestic hot water set point temperature). If it is determined at the step 403 that the error amount is not greater than the error threshold, the process 400 ends at a step 405. If, however, it is determined at the step 403 that the error amount is greater than the error threshold, the process continues to a step 404 where one or more operational characteristics of the combination boiler 100 are selectively modified. The one or more operational characteristics of the combination boiler 100 may include an assumed or measured DHW inlet temperature, a setting of at least one of the inlet pump 104 and the flow diverting valve 414, or other operational setting. The process then ends at a step 405.

An error correction process, for example as illustrated by FIG. 4, compares a DHW output temperature to a DHW set point temperature in order to determine an error amount. The controller 120 may be configured to selectively modify at least one operation of the combination boiler 100 based on the determined error amount. The selectively modified operation may take the form of controlling, initializing, or modifying a heat input rate (e.g., fan speed) of the input fan 110 in one exemplary embodiment. Alternatively or additionally, an assumed DHW input temperature may be modified at least in part based upon the error amount.

Although described herein with reference to initialization of a fan speed, it should be appreciated that a running fan speed of the input fan 110 may be modified on a continuing operational basis within the spirit and the scope of the present disclosure. For example after initialization, the controller 120 may be configured to control operations of at least one of the flow diverting valve 114 and the inlet pump 104 to maintain an output temperature of the domestic loop to correspond to a DHW set point temperature. As described herein, a DHW output flow rate may be estimated and used to subsequently determine a required heat input by the burner 108 firing by looking at one or more sensors available to the controller 120. The controller 120 may then look at the DHW outlet temperature error as compared to a set point temperature to further modify the estimated required heat input and initialize an advanced fan speed accordingly once the burner 108 has ignited.

In one exemplary embodiment, the flow diverting valve 114 and inlet pump 104 constitute a known flow circuit for the combination boiler 100, and therefore correspond to a known boiler loop flow rate when operating in a DHW mode. Implementations consistent with the present disclosure include estimating a DHW flow rate by comparing the boiler loop temperature change (i.e., outlet temperature minus inlet temperature) with a domestic hot water temperature rise. If the combination boiler 100 is not equipped with a DHW inlet temperature sensor, an assumed DHW inlet temperature may be used as described herein.

Figure 5:
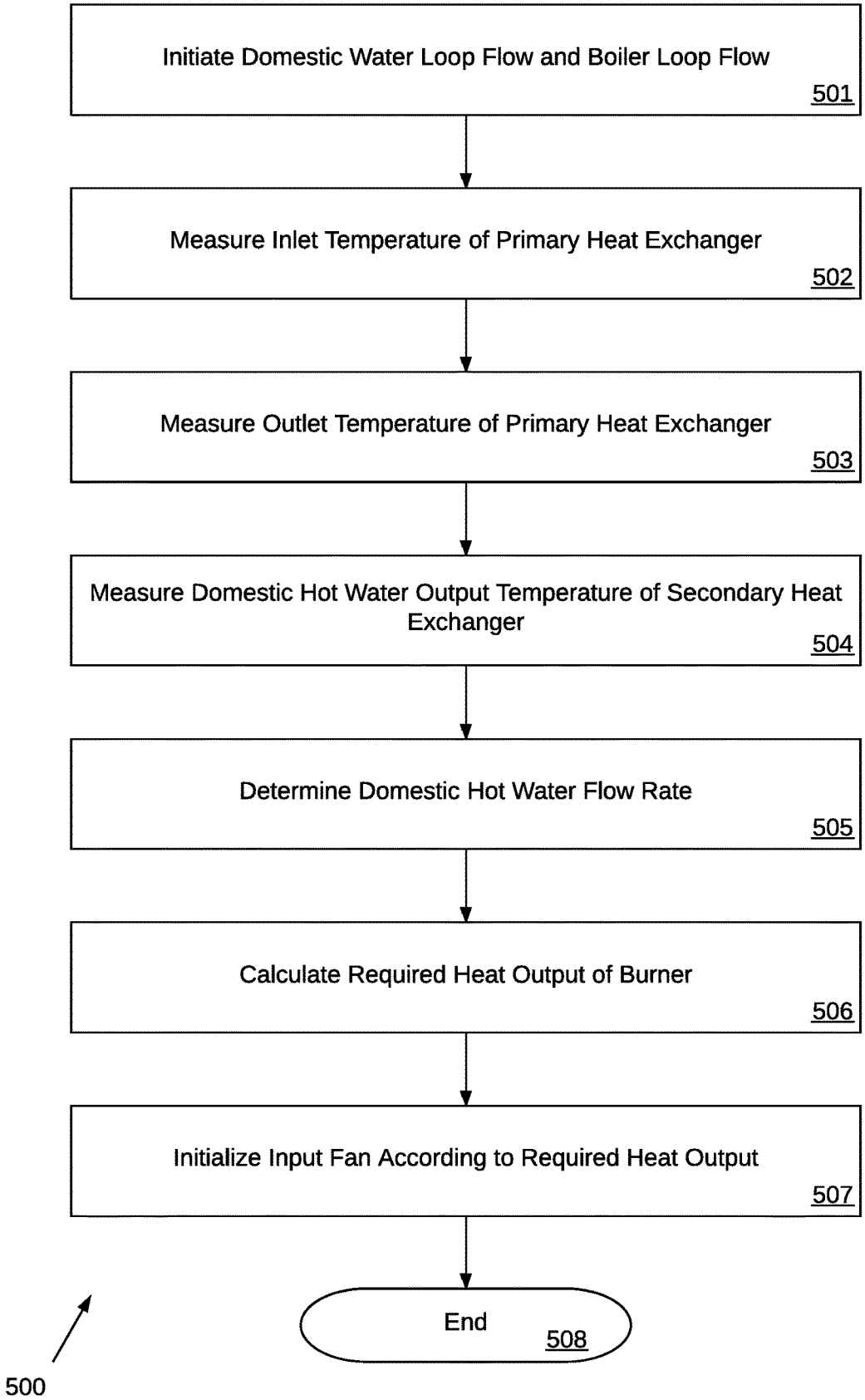
FIG. 5 is a flowchart representing a process for controlling an input fan of a combination boiler according to an exemplary embodiment.

FIG. 5 provides a flowchart representing a process for controlling an input fan of the combination boiler 100 according to an exemplary embodiment. The process 500 begins at a step 501, where a domestic water loop flow and boiler loop flow are initiated. The boiler loop flow may be initiated, for example, by the inlet pump 104. The domestic water loop flow may be initialized, in one exemplary embodiment, by a domestic water draw associated with an output of the secondary heat exchanger 116. In one exemplary embodiment, before the burner 108 fires, but sometime after the domestic loop and boiler loop flows have been initiated, the controller 120 is configured to measure a temperature differential of the boiler loop, as well as an estimated temperature differential of the domestic loop. The heat transferred out of the boiler loop may be represented by the boiler loop temperature differential multiplied by the known boiler loop flow rate. As this heat transfer rate is equal to the heat transfer rate into the domestic water loop, the domestic water loop temperature differential can be used to estimate the DHW flow rate.

The process 500 continues to a step 502, where an inlet temperature (T1) of the primary heat exchanger 106 is measured. The outlet temperature (T2) of the primary heat exchanger 106 is measured at a step 503. At a step 504 a DHW output temperature of the secondary heat exchanger 116 is measured. At a step 505 the DHW flow rate is determined in the manner previously described herein. A required heat output of the burner 108 is calculated at a step 506. The controller 120 causes the input fan 110 of the combination boiler 100 to control according to the required heat output at a step 507. The process 500 concludes at a step 508.

Although described with reference to water loops, it should be appreciated that a combination boiler 100 in accordance with the present disclosure may be configured to heat one or more liquids via a primary fluid that may be directly or indirectly heated in a manner as described herein. For example, a combination boiler 100 may include a water heater providing a secondary space heating function using a secondary space heating function and a water heating element implementing two or more liquid sources for functionality. Alternatively or additionally, one or more exemplary embodiments may include a water heater without a space heating capability (e.g., as a system similar to that illustrated by FIG. 1, without requiring a BOILER_OUT and/or BOILER_IN connection, which may or may not include a different liquid to heat a loop liquid (e.g., as a heat pump water heater).

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct connection between the connected items or an indirect connection through one or more passive or active intermediary devices.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The term "communications network" as used herein with respect to data communication between two or more parties or otherwise between communications network interfaces associated with two or more parties may refer to any one of, or a combination of any two or more of, telecommunications networks (whether wired, wireless, cellular or the like), a global network such as the Internet, local networks, network links, Internet Service Providers (ISP's), and intermediate communication interfaces.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A method of controlling domestic hot water (DHW) output temperature in a combination boiler to minimize overshoot or undershoot of a DHW output set point temperature of output domestic water in a system having a primary heat exchanger connected to a boiler loop, a burner configured to provide heat to the primary heat exchanger, an input fan configured to supply a fuel and air mixture to the burner, and a secondary heat exchanger configured to transfer heat energy from the boiler loop to a domestic water loop, the method comprising:

determining a boiler loop flow rate;

measuring an input temperature of the primary heat exchanger, an output temperature of the primary heat exchanger, and a DHW output temperature of the secondary heat exchanger;

estimating a DHW flow rate based at least in part upon the boiler loop flow rate, the input temperature of the primary heat exchanger, and the output temperature of the primary heat exchanger;

operating the input fan according to a heat output demand of the burner corresponding to the DHW flow rate; and providing the output domestic water from the secondary heat exchanger corresponding to the DHW output set point temperature based at least in part upon the operating the input fan according to the heat output demand of the burner corresponding to the DHW flow rate.

2. The method of claim 1, wherein the boiler loop includes an inlet pump and a flow diverting valve, and wherein the boiler loop flow rate is determined based at least in part upon an operational characteristic of at least one of the inlet pump and the flow diverting valve.

3. The method of claim 2, wherein the boiler loop flow rate corresponds to a flow rate of boiler loop water passing through the secondary heat exchanger via the flow diverting valve.

4. The method of claim 1, further comprising:

comparing the DHW output temperature to a DHW set point temperature to determine an error amount; and selectively modifying operation of the combination boiler based on the error amount.

5. The method of claim 4, wherein a fan speed of the input fan is modified based at least in part upon the error amount.

6. The method of claim 1, wherein the DHW flow rate is estimated by (i) determining a product of the boiler loop flow rate and a difference between the input temperature of the primary heat exchanger and the output temperature of the primary heat exchanger, and (ii) dividing the product by the difference between the DHW output temperature and an assumed DHW input temperature.

7. The method of claim 6, wherein the assumed DHW input temperature is a predetermined value.

8. A combination boiler system for providing heated water to a boiler loop and heated domestic hot water (DHW) to a DHW loop while minimizing overshoot or undershoot of a DHW output set point temperature of output domestic water, the combination boiler system comprising:

a primary heat exchanger connected to the boiler loop, a burner configured to provide heat to the primary heat exchanger, an input fan configured to supply a fuel and air mixture to the burner, a secondary heat exchanger configured to transfer heat energy from the boiler loop to a domestic water loop; and a controller configured to:

determine a boiler loop flow rate;

measure an input temperature of the boiler loop, an output temperature of the boiler loop, and a DHW output temperature of the domestic water loop;

estimate a DHW flow rate based at least in part upon the boiler loop flow rate, the input temperature of the boiler loop, and the output temperature of the boiler loop;

operate the input fan according to a heat output demand of the burner corresponding to the DHW flow rate; and provide the output domestic water from the secondary heat exchanger corresponding to the DHW output set point temperature based at least in part upon operating the input fan according to the heat output demand of the burner corresponding to the DHW flow rate.

9. The combination boiler system of claim 8, the combination boiler system further comprising:

an inlet temperature sensor connected to the boiler loop, the inlet temperature sensor configured to measure the input temperature of the boiler loop.

10. The combination boiler system of claim 8, the combination boiler system further comprising:

an input pump configured to circulate water in the boiler loop;

a flow diverting valve connected to the boiler loop, the flow diverting valve configured to selectively divert heated water from the boiler loop to the secondary heat exchanger, wherein the controller is configured to determine a boiler loop flow rate based upon an operational setting of at least one of the input pump and the flow diverting valve.

11. The combination boiler system of claim 8, wherein the controller is further configured to:

compare the DHW output temperature to a DHW set point temperature to determine an error amount; and selectively modify operation of the combination boiler system based on the error amount.

12. The combination boiler system of claim 11, wherein the controller is configured to modify a fan speed of the input fan based at least in part upon the error amount.

* * * * *